US011746989B1

(12) United States Patent
Ai et al.

(10) Patent No.: US 11,746,989 B1
(45) Date of Patent: Sep. 5, 2023

(54) EXTREME CUTOFF BEAM CONTROL OPTICS

(71) Applicant: ABL IP Holding LLC, Atlanta, GA (US)

(72) Inventors: Qi Ai, Peachtree City, GA (US); Jie Chen, Snellville, GA (US); Craig Eugene Marquardt, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/686,799

(22) Filed: Mar. 4, 2022

(51) Int. Cl.

| | |
|---|---|
| ***F21V 13/04*** | (2006.01) |
| ***F21V 5/00*** | (2018.01) |
| ***F21V 7/04*** | (2006.01) |
| *F21S 8/08* | (2006.01) |
| *F21Y 115/10* | (2016.01) |

(52) U.S. Cl.
CPC ..... *F21V 13/04* (2013.01); *F21V 5/007* (2013.01); *F21V 7/04* (2013.01); *F21S 8/086* (2013.01); *F21Y 2115/10* (2016.08)

(58) Field of Classification Search
CPC ..... F21V 13/04; F21V 5/007; F21V 5/08; F21W 2131/103; F21S 8/08; F21S 8/06
See application file for complete search history.

(56) References Cited

U.S. PATENT DOCUMENTS

| | | | | |
|---|---|---|---|---|
| 7,674,018 | B2 | 3/2010 | Holder et al. | |
| 7,934,851 | B1 * | 5/2011 | Boissevain | F21V 29/74 362/249.02 |
| 8,092,042 | B2 * | 1/2012 | Wilcox | F21V 13/02 362/249.02 |
| 8,210,722 | B2 | 7/2012 | Holder et al. | |
| 9,039,252 | B2 | 5/2015 | Treanton | |
| 9,400,087 | B2 | 7/2016 | Marquardt et al. | |
| 9,816,672 | B1 | 11/2017 | Broughton | |
| 10,168,023 | B1 | 1/2019 | Hein | |
| 10,222,027 | B2 | 3/2019 | Broughton | |

(Continued)

FOREIGN PATENT DOCUMENTS

| | | | |
|---|---|---|---|
| CA | 2630114 | A1 | 10/2009 |

OTHER PUBLICATIONS

EP Application No. 23160000.8, Extended European Search Report, dated Jul. 7, 2023, 9 Pages.

*Primary Examiner* — Oluseye Iwarere
*Assistant Examiner* — Michael Chiang
(74) *Attorney, Agent, or Firm* — Kilpatrick Townsend & Stockton LLP

(57) ABSTRACT

Disclosed herein is an optical assembly and a luminaire with extreme cutoff beam control optics. The optical assembly includes a base, a plurality of lenses disposed on the base and spaced from each other, a plurality of light emitting diodes (LED), and a reflector having a curved surface (e.g., concave shape, parabolic shape, etc.) disposed adjacent to at least one of the plurality of LEDs. A central axis of an LED may be offset from a central axis of the respective lens of the plurality of lenses. The curved surface may extend from the base and curving over the at least one of the plurality of LEDs and beyond the central axis of each of the at least one of the plurality of LEDs and direct light in a desired direction or a selected area (e.g., a street side) and cut off light in other direction (e.g., a house side).

20 Claims, 14 Drawing Sheets

(56) References Cited

U.S. PATENT DOCUMENTS

| | | | | |
|---|---|---|---|---|
| 2004/0174706 | A1* | 9/2004 | Kan | F21V 13/04 362/241 |
| 2009/0323330 | A1* | 12/2009 | Gordin | F21V 11/00 362/249.02 |
| 2010/0240158 | A1* | 9/2010 | Ter-Hovhannissian | F21K 9/90 257/E33.056 |
| 2012/0008320 | A1* | 1/2012 | Tu | F21V 11/02 362/235 |
| 2014/0063802 | A1* | 3/2014 | Garcia | F21V 5/08 362/241 |
| 2014/0133181 | A1* | 5/2014 | Ishida | G02B 6/0038 362/613 |
| 2015/0078011 | A1* | 3/2015 | Sy | F21V 7/048 362/327 |
| 2019/0101262 | A1* | 4/2019 | Jou | F21V 5/08 |
| 2021/0215308 | A1* | 7/2021 | Caprara | F21S 8/085 |

* cited by examiner

EXTREME CUTOFF BEAM CONTROL OPTICS

FIELD OF DISCLOSURE

This disclosure relates generally to an optical assembly that can be used in luminaires and other light elements, and more particularly to reflectors around light emitting diodes (LED) to direct light beam from LEDs to a desired direction while cutting off the light beam from travelling to an undesired direction.

BACKGROUND

Light emitting diodes (LED) are typically used in luminaires for street lighting, porch lighting, back yard lighting, in house lighting, decorative lighting, or other lighting purpose. LED lights used in roadway luminaires typically include a series of LEDs arranged in rows, with the LEDs being covered by an optic designed to provide a particular light distribution profile. In outdoor lighting applications, it may be desirable to direct light toward a desired direction (such as toward a street, parking lot, or other area), while preventing light from being directed toward an undesired direction to leave other areas, such as unpaved areas, buildings, yards, and the like, unlit. However, traditional lighting systems may not provide the ability to carefully cutoff off light such that predominately all light emitted from the lighting system is emitted in a desired direction. Therefore, improvements in light cutoff capabilities of lighting systems are desired

BRIEF SUMMARY

One aspect of the present disclosure relates to an optical assembly configured to direct light in a desired direction. The optical assembly includes a base, a plurality of lenses disposed on the base and spaced from each other in a row. Each lens may have a dome shape with a central axis perpendicular to a plane of the base. The optical assembly can include a plurality of light emitting diodes (LED). Each LED can be disposed between the base and a respective lens of the plurality of lenses. Each LED can have a central axis perpendicular to a plane of the LED. The central axis of an LED may be offset from the central axis of the respective lens of the plurality of lenses. At least one reflector having a curved surface (e.g., concave shape, parabolic shape, etc.) may be disposed adjacent to at least one of the plurality of LEDs such that the at least one of the plurality of LEDs are at a first side of the at least one reflector. The curved surface may extend from the base and curving over the at least one of the plurality of LEDs and beyond the central axis of each of the at least one of the plurality of LEDs. The curved surface can be configured to direct light emitted by the at least one of the plurality of LEDs toward the first side and prevent the light from leaking toward a second side of the at least one reflector that is opposite the first side.

In some embodiments, each lens of the plurality of lenses defines a cavity, and each LED of the plurality of LEDs may be disposed in a respective one of the cavities such that the central axis of the LED is offset relative to a central axis of the respective lens in a direction of the curved surface of the at least one reflector.

In some embodiments, the curved surface of the reflector may have a free form shape characterized by multiple curvatures between end points of the curved surface, a first end point being at the base and a second end point being positioned above at least some of the plurality of lenses. For example, a first curvature may be between the first end point at the base and an intermediate point between the first end point and the second end point, and a second curvature may be between the intermediate point and the second end point of the curved surface.

In some embodiments, the curved surface of the reflector may be characterized by a first angle between a plane of the base and a first line (e.g., joining a distal end of a lens furthest from the curved surface and a distal end of the curved surface located over the lens). For example, the first angle is in a range between 60° and 90° . In some embodiments, the curved surface of the reflector may be characterized by a second angle between the plane of the base and a second line (e.g., a line joining a point on the lens located at the central axis of the LED and the distal end of the curved surface located over the lens). For example, the second angle is in a range between 70° and 130°.

Further, one aspect of the present disclosure relates to a luminaire. The luminaire includes a base, a plurality of lenses disposed on the base and spaced from each other, a plurality of light emitting diodes (LED) disposed between the base and a respective lens of the plurality of lenses, at least one reflector having a curved surface and disposed proximate to at least one of the plurality of LEDs, and a frame supporting the base and the at least one reflector.

In some embodiments, each lens may have a dome shape having a central axis perpendicular to a plane of the base.

In some embodiments, each LED may have a central axis perpendicular to a plane of the LED, and the central axis of an LED may be offset from the central axis of a respective lens of the plurality of lenses.

In some embodiments, the curved surface of the reflector may extend from a surface of the base and curving over the at least one of the plurality of LEDs and beyond the central axis of each of the at least one of the plurality of LEDs. The curved surface may be configured to direct light emitted by the at least one of the plurality of LEDs toward the first side and prevent the light from leaking toward a second side of the at least one reflector that is opposite the first side.

In some embodiments, the frame may be oriented such that the curved surface of the at least one reflector curves toward the street to direct the light from the at least one of the plurality of LEDs toward a street side and prevent light from leaking in a direction that is away from the street.

The forgoing general description of the illustrative implementations and the following detailed description thereof are merely exemplary aspects of the teachings of this disclosure, and are not restrictive.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and can or cannot represent actual or preferred values or dimensions. Where applicable, some or all features cannot be illustrated to assist in the description of underlying features. In the drawings.

DETAILED DESCRIPTION

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) can be practiced without those specific details. In some instances, well-known structures and components can be shown in block diagram form in order to avoid obscuring the concepts of the disclosed subject matter.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics can be combined in any suitable manner in one or more embodiments. Further, it is intended that embodiments of the disclosed subject matter cover modifications and variations thereof.

It is to be understood that terms such as "top," "bottom," "front," "side," "length," "lower," "interior," "inner," "outer," and the like that can be used herein merely describe points of reference and do not necessarily limit embodiments of the present disclosure to any particular orientation or configuration. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation.

Figure 1:
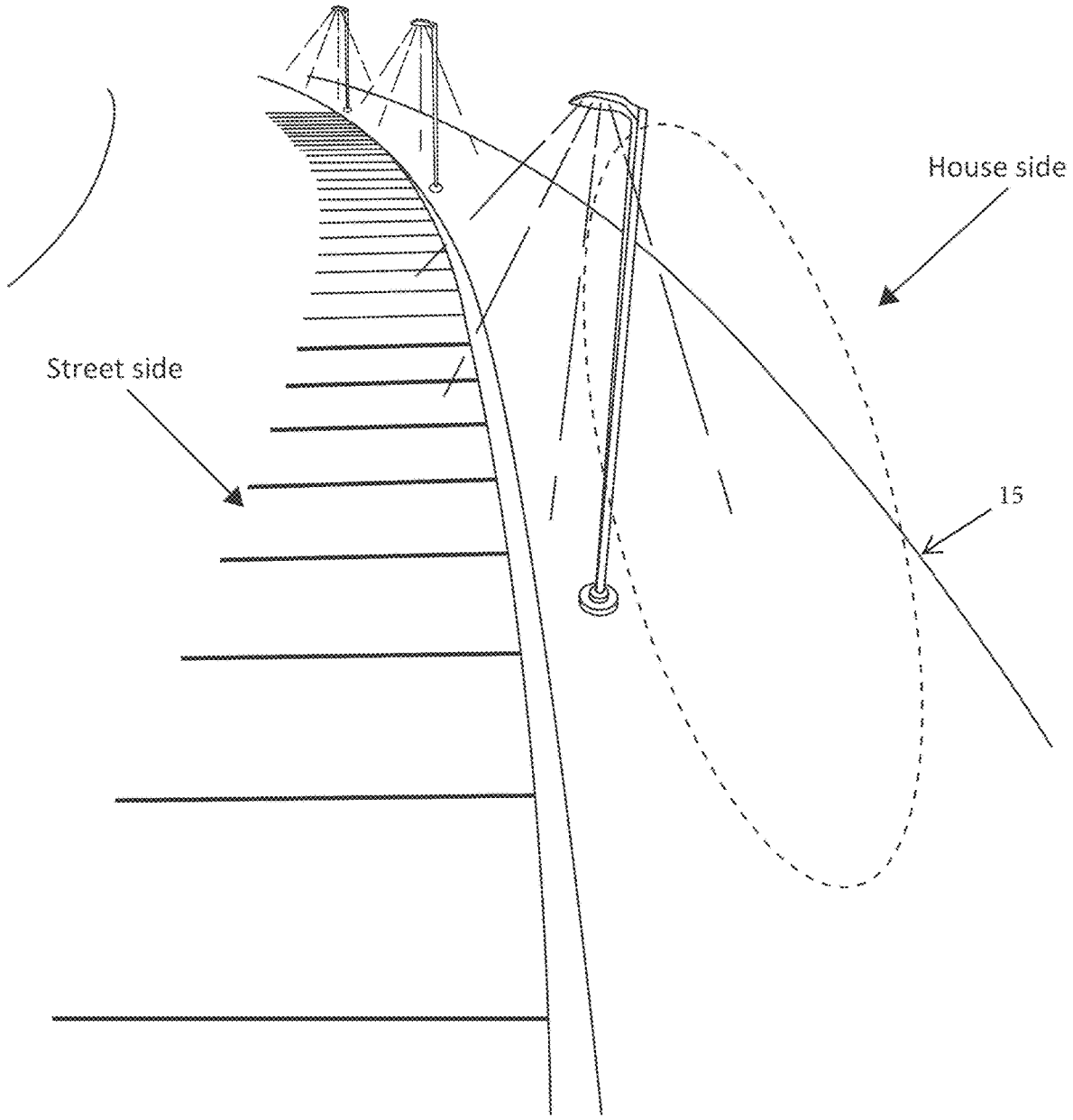
FIG. 1 (Prior Art)
FIG. 1 illustrates backlight leakage associated with a prior art street light.

Conventional lighting applications may attempt to control an amount of back light or corner light to meet visibility/non-visibility, intensity or other specifications. However, existing back light control and corner control optics have several limitations. For example, conventional optics may not be able to produce a light distribution having a sharp and precise backlight cutoff, which may result in a backlight cutoff line which is spaced apart from a fixture installation line and may enable unwanted light to spill in an undesired direction, such as toward neighboring properties (e.g., see FIG. 1). Existing optics may also be unable to meet specification related to a LEED program such as LEED v4 program and earning additional points.

The present disclosure provides an optical assembly that overcomes several limitations above. In some embodiments, the optical assembly herein comprises a reflector frame that offers extreme light cut off while also reflecting a greater portion of light in the desired direction to improve light coverage. In some embodiments, the extreme light cut off may be characterized by mounting height to back light distance ratio. For example, if the optical assembly is mounted at a height of 20 feet, the back light cutoff will be less than 5 feet rearward of the pole. Some embodiments, ratios lower than 0.25 may be achieved. For example, comparing a first cut off line 15 (in FIG. 1) and another cut off line 25 (in FIG. 2) shows that the cut off line 25 is much closer to the street than the house side, thereby achieving much sharper cut off using the optical assembly of the present disclosure.

Additionally, an asymmetric lens design is provided that can greatly reduce the reflector size while offering more precise and/or sharp light cutoff. The structure of the lens can take various forms. In some non-limiting examples, the lens may include a clear optic that is co-molded into a base (e.g., a black base), a clear optic that is glued and/or otherwise secured to a base, and/or may include an integrally formed base and optic, with a surface of the base being painted. In some embodiments, the lens and/or base may include a silicone material, as silicone can offer great photometric performance and very good thermal performance.

In some embodiments, the optical assembly comprises one or more light sources, a number of lenses (e.g., made of PMMA or silicone material) placed over the light sources, and one or more reflectors (e.g., made of pure black plastic and vacuum metalized reflective surface) placed proximate the lens. Different components of the optical assembly and their configuration are further discussed in detail with respect to FIGS. 3-12, according to some embodiments.

Figure 3:
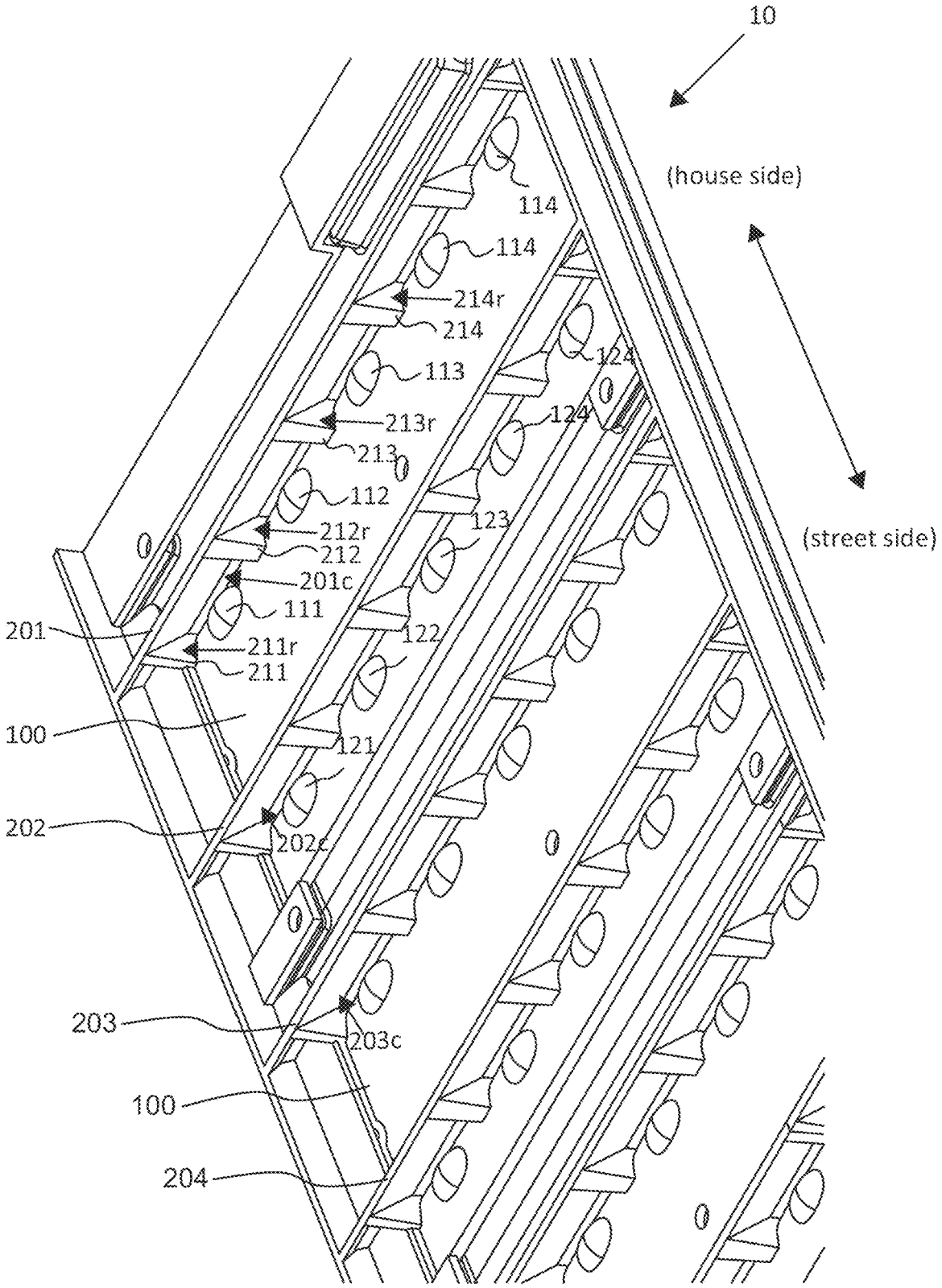
FIG. 3 is a perspective view of an optical assembly including a reflector with curved surface, according to one embodiment.

FIG. 3 is a perspective view of an optical assembly 10, according to one embodiment. The optical assembly 10 includes a base 100, a plurality of lenses 111-115 and 121-123 disposed on the base 100, a plurality of light sources 150 (e.g., shown in FIG. 4C) disposed in the plurality of lenses 111-115, and one or more reflectors 201 that each have a curved surface 201*c* disposed adjacent to one or more of the plurality of light sources 150 and/or the plurality of lenses 111-115. In some embodiments, the light sources 150 can be light emitting diodes (LED) 150. The curved surface 201*c* in combination with the lenses 111-115 and LEDs 150 allows the light to be directed in a desired direction. The curved surface 201*c* is also configured to cutoff light from traveling in undesired directions. For example, as will be discussed in greater detail below, the reflectors 201 may be positioned relative to the LEDs 150 and lenses 111-115 such that light emitted from each lens 111-115 in undesired directions may contact one of the curved surfaces 201*c,* which then reflects such light in a desired direction and/or otherwise away from the undesired direction. The base 100 can also prevent the light from the LEDs from traveling in other directions than the desired direction. For example, in some embodiments, the base 100 may be formed from and/or coated with a black (or other dark color) material. This may enable the base 100 to absorb light directed toward the base 100 to prevent and/or reduce the amount of light reflected by the base 100, some of which may otherwise be reflected in an undesired direction. Light emitted from the LEDs 150 and/or lenses 111-115 in a downward direction and/or light reflected in a downward direction using the reflectors 201 may be absorbed by the base 100, which may prevent such light from being directed in an undesired direction (e.g., a house side direction). In some embodiments, the optical assembly 10 can be a luminaire used to light a street. In this example, the desired direction is a street side and an undesired direction is a house side such as a front yard or a back yard. The components of the optical assembly including the lenses, the LEDs and reflectors are further discussed in detail below.

Figure 2:
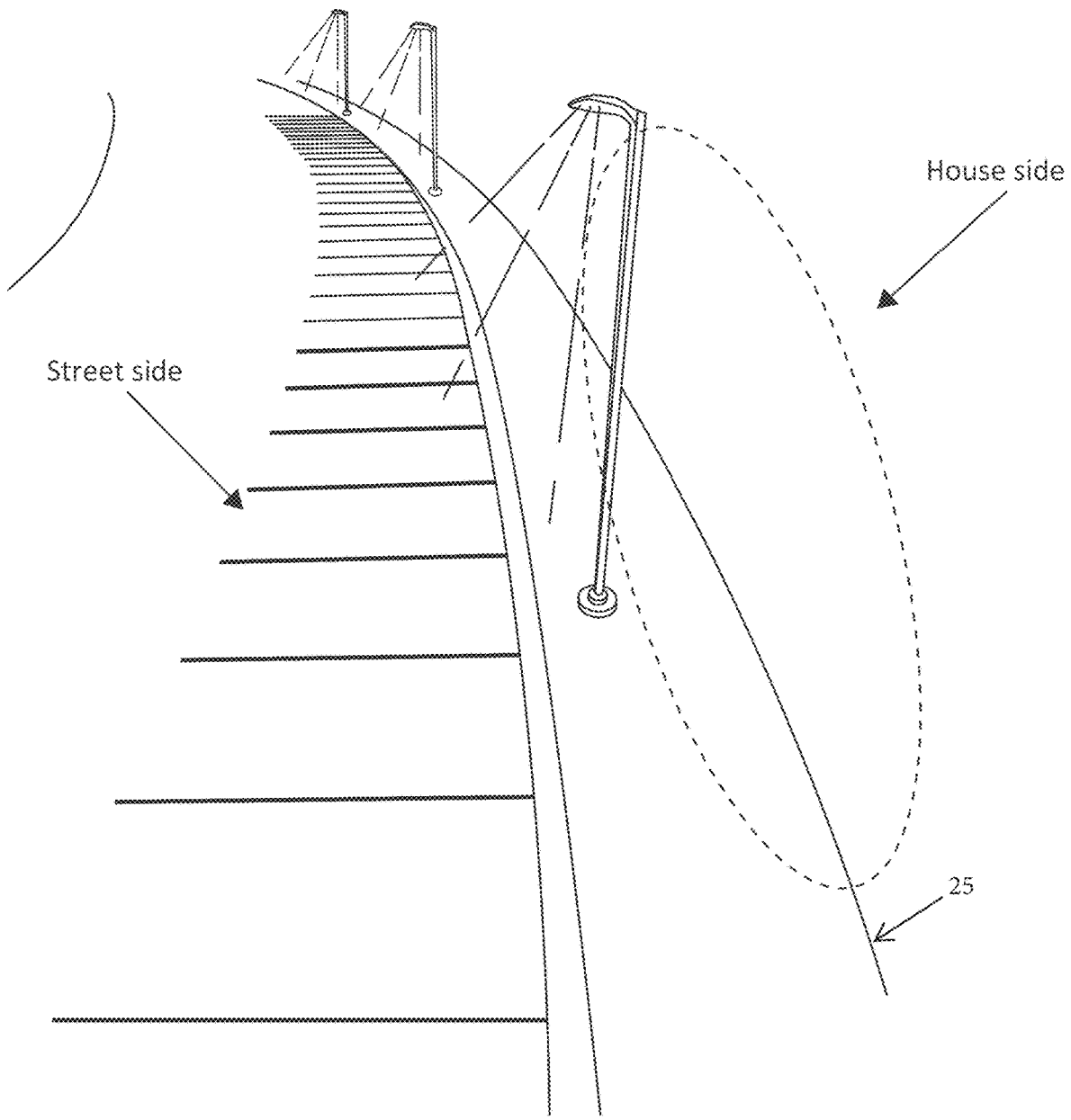
FIG. 2 illustrates a street light with improved backlight control, according to one embodiment.

A light source emits light that can be received and further distributed by the lens, as discussed herein. In some embodiments, the light source can be or can comprise one or more light emitting diodes, for example. The light source and/or the emitted light can have an associated optical axis. The light source can be deployed in applications where it is desirable to bias illumination laterally relative to the optical axis. For example, as shown in FIGS. 2 and 7B, in a street luminaire where the optical axis is pointed down towards the ground, it may be beneficial to direct light towards the street side of the optical axis, rather than towards a row of houses that are beside the street (e.g., see FIG. 2). The light source can be coupled to a lens that receives light propagating on one side or both sides of the optical axis and redirects that light toward the reflector and/or sends the light forward toward the street side. For example, the lens can receive light that is headed towards the houses and redirect that light towards the street via the reflector 201.

Figure 4A:
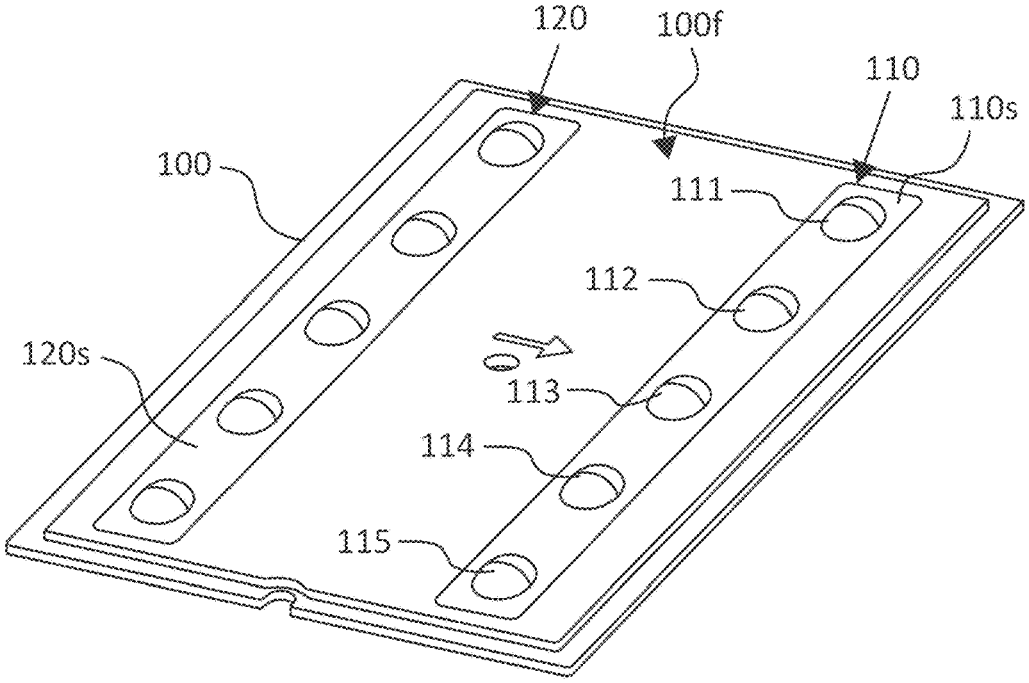
FIG. 4A is a top perspective view of a lens or optic arranged on a base surface, according to one embodiment.
Figure 4B:
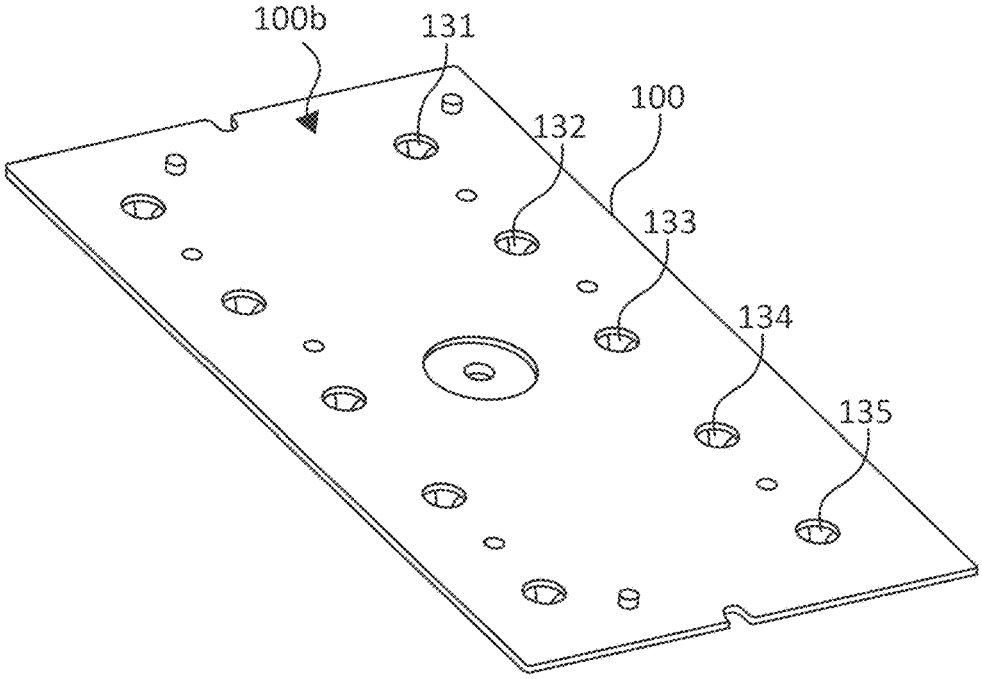
FIG. 4B is a bottom perspective view of the base surface showing access to a cavity of the lens for mounting a light source, according to one embodiment.
Figure 4C:
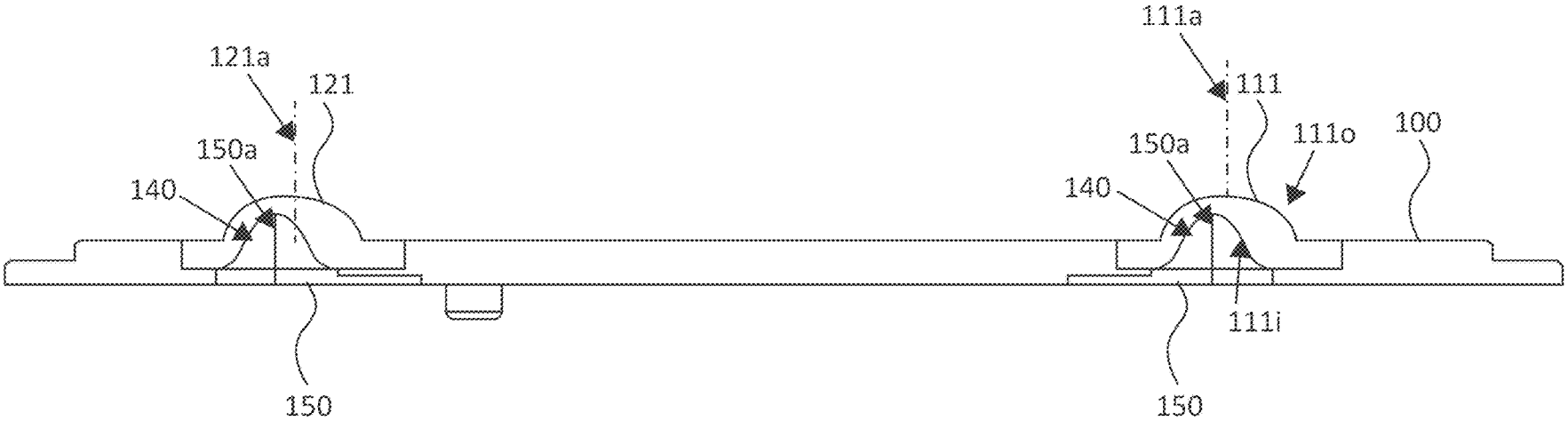
FIG. 4C is a cross-section view of a lens disposed on the base showing the light source disposed in the cavity of the lens, according to one embodiment.
Figure 5:
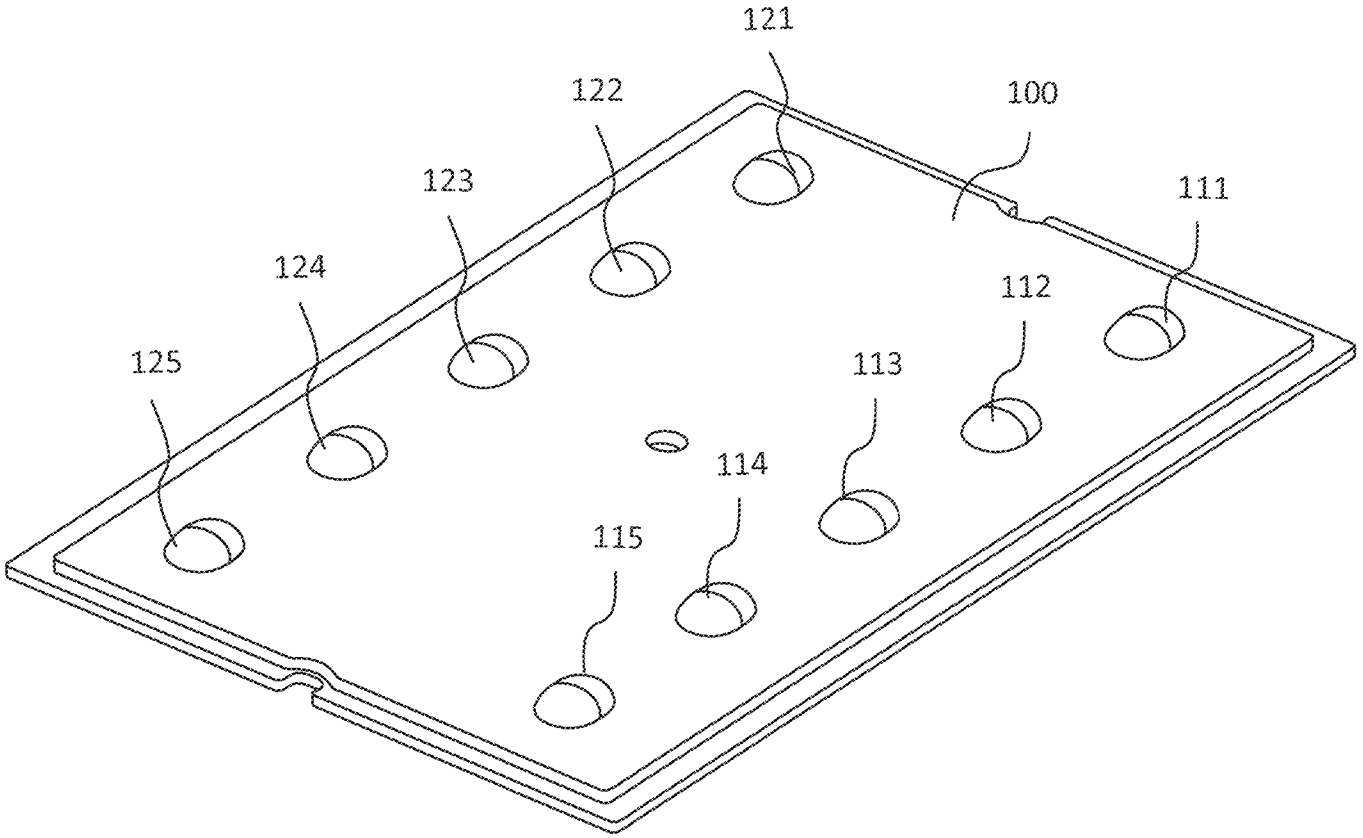
FIG. 5 is a perspective view of a lens or optic co-molded to a base, according to one embodiment.

In some embodiments, as shown in FIGS. 3, 4A and 5, the plurality of lenses 111-115 are disposed on the base 100 and spaced from each other in a row 110. Similarly another plurality of lenses are disposed in another row 120. In one embodiment, as shown in FIGS. 3, and 4A, the lenses 111-115 in each row can be provided in a sheet form 110*s* or a single strip 110*s* to facilitate coupling multiple lenses to a corresponding array of LEDs. Providing the lenses 111-115 in sheet form 110*s* and/or as a single strip 110*s* may facilitate coupling the lenses to the base 100. For example, the lens sheets 110*s* and 120*s* are coupled to a first surface 100*f* (e.g., a front surface in FIG. 4A) of the base 100. An inner surface of each lens 111-115 may define a cavity 140 (as shown in FIG. 4C) or other volume that may receive a respective one of the LEDs 150. Each recess may include an opening 131-135 that provides access to the interior of the recess. The openings 131-135 of the lenses 111-115 can be accessed from an opposite second surface 100*b* (e.g., a back surface in FIG. 4B). The array of LEDs can be disposed though the openings from the second surface 100*b*. Such an array of LEDs would typically be under the illustrated sheet. Accordingly, an optical assembly or an illumination system can comprise a two-dimensional array of LEDs. The resulting two-dimensional array of LEDs can comprise a light module or light bar, one or more of which can be disposed in a luminaire or other lighting apparatus, for example.

In some example embodiments, the lenses 111-115 (and lenses on the sheet 120*s*) can be formed of optical grade silicone and can be pliable and/or elastic. In some example embodiments, the lenses 111-115 can be formed of an optical plastic such as poly-methyl-methacrylate (PMMA), polycarbonate, silicone, or an appropriate acrylic, to mention a few representative material options without limitation. In some embodiments, the base 100 can also be PMMA and painted black (or other dark color), or can be made of a dark material, such as silicone. By providing the base 100 with a black or otherwise dark outer surface, any light incident on the first surface 100*f* can be absorbed and not reflected thereby preventing light leakage toward an undesired direction (e.g., the house side).

Referring to FIG. 5, the plurality of lenses 111-115 and 121-125 can be individually coupled to the base 100. In some embodiments, the plurality of lenses 111-115 and 121-125 can be glued or co-molded with the base 100. For example, the plurality of lenses 111-115 and 121-125 can be attached to the base 100 by an adhesive. In other embodiments, the lenses 111-115 may be snapped, fastened, and/or otherwise mechanically secured with the base 100.

Figure 6:
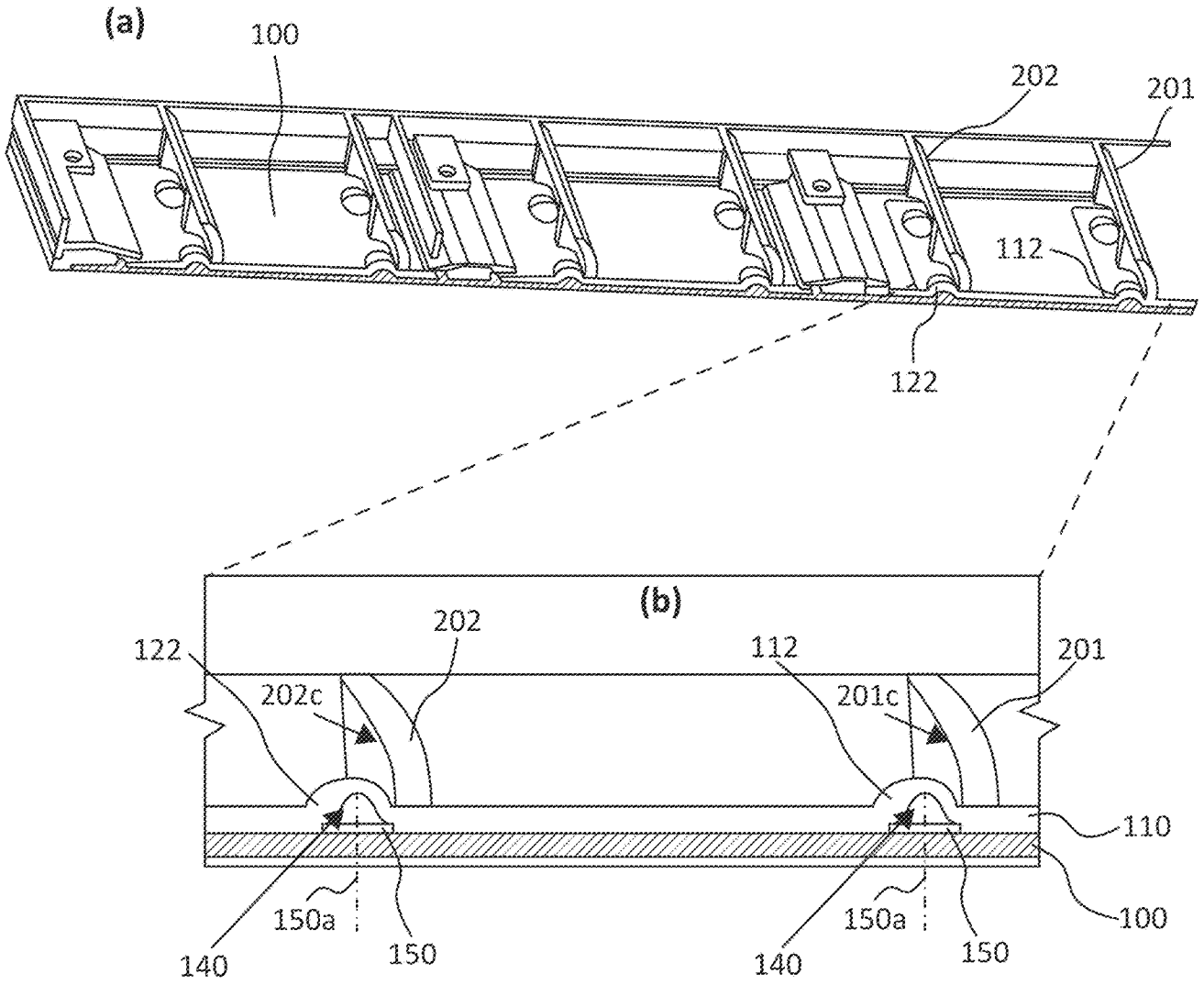
FIG. 6 illustrates cross-section of an optical assembly, (a) showing a perspective view of an optical assembly and a cross-section, and (b) showing a front view of the cross-section illustrating a cross-section of reflectors, lenses, and light sources, according to one embodiment.

As shown in FIGS. 4C and 5, the lenses 111-115 can be dome shaped with a central axis perpendicular to a plane of the base 100. For example, the lenses 111 and 121 have central axes 111*a* and 121*a,* respectively, as shown in FIG. 4C. In some embodiments, as shown in FIGS. 6(*b*) and 9A-9B, the LED 150 of the plurality of LEDs is disposed in a cavity 140 of lens 111 of the plurality of the lens 111-115 such that the central axis 150*a* of the LED is offset from the central axis 111*a* of the lens 111 in a direction toward the curved surface 201*c* of the reflector 201. In one embodiments, the plurality of lenses 111-115 have a corresponding plurality of LEDs 150 disposed therein such that the central axes of the lenses are offset close to the reflector 201.

In some embodiment, as shown in FIGS. 4C and 6(*b*), each of the plurality of light emitting diodes (LED) 150 are placed in a corresponding lens of the plurality of lenses 111-115.

The LED 150 has a central axis 150*a* perpendicular to a plane of the LED or perpendicular to the base 100. In one embodiment, as shown in FIGS. 4C and 8A-8C, the central axis 150*a* of an LED is offset from the central axis 111*a* of an outer surface of the lens 111 of the plurality of lenses 111-115. In one embodiment, the central axis 150*a* of the LED 150 and a central axis 111*a* of the inner surface 111*i* of the cavity 140 of the lens 111 are aligned or not offset from each other.

Figure 7A:
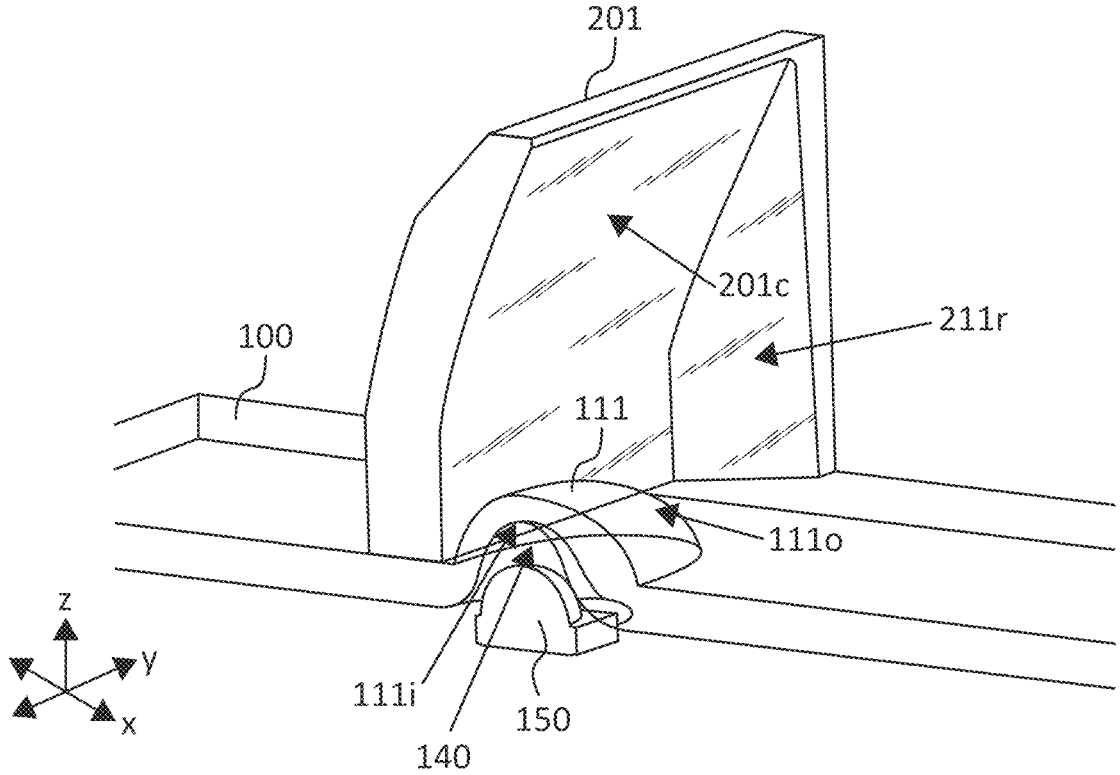
FIG. 7A is a perspective cross-section view of the reflector, lens and a light source arranged in an optical assembly, according to one embodiment.
Figure 7B:
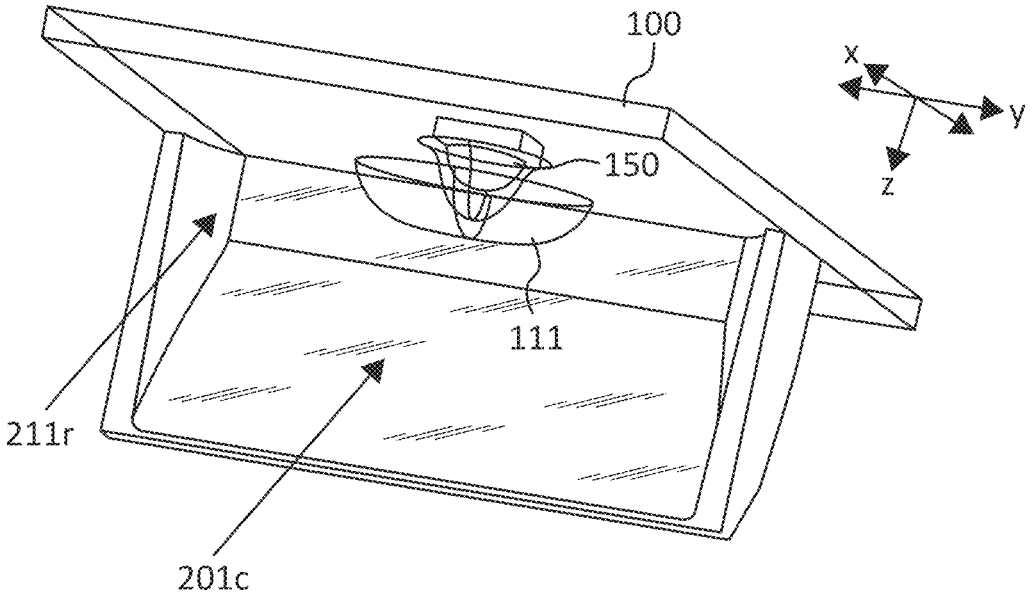
FIG. 7B is a perspective of an optical assembly with a central axis of the light source pointing downward and reflector directing the light from the light source toward the front, according to one embodiment.
Figure 8A:
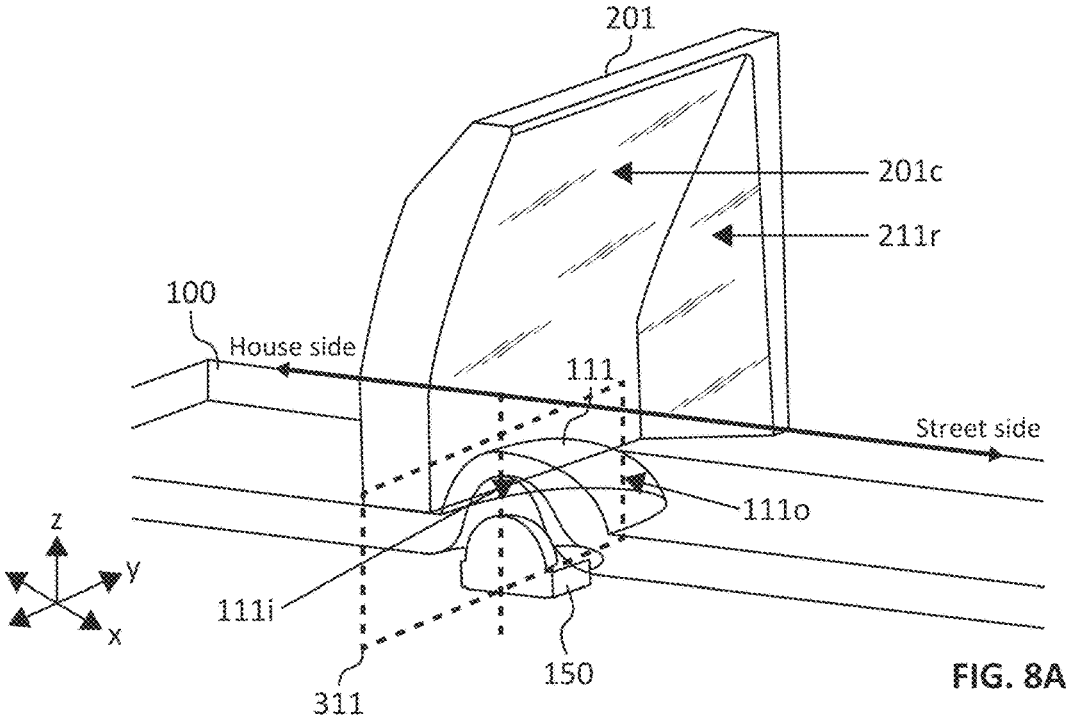
FIG. 8A is a perspective cross-section view of the reflector, lens and a light source arranged in an optical assembly, according to one embodiment.
Figure 8B:
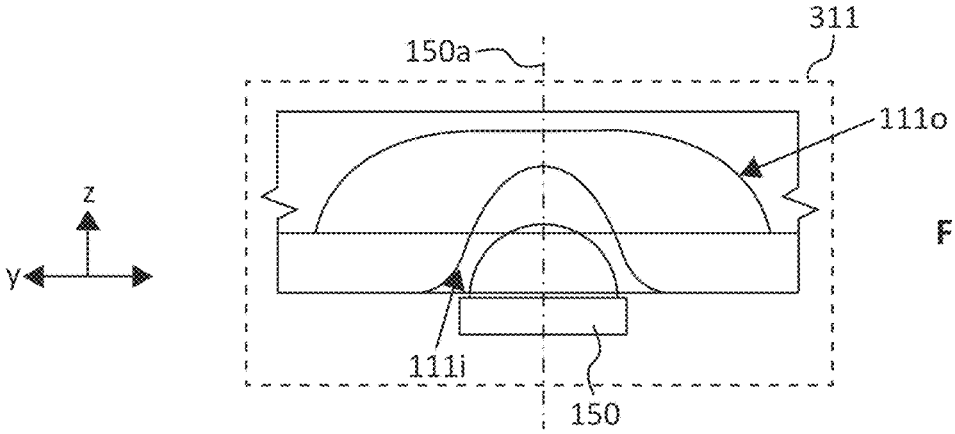
FIG. 8B is a cross-section view of the lens and the light source viewed from a side (e.g., house side) illustrating a symmetric configuration of the lens with respect to the light source, according to one embodiment.

FIGS. 7A and 8A illustrate a cross-section view showing structure of an exemplary lens 111, according to one embodiment. As shown, the lens 111 has a dome shape with an inner surface 111*i* facing the LED 150 and an outer surface 1110 facing away from the LED 150, opposite the inner surface 111*i*. The inner surface 111*i* can comprise a refractive surface that receives light headed away from the optical axis of the LED 150, for example away from the street to be lighted. The inner surface 111*i* can be a concave lens surface facing toward the LED 150, with the inner surface 111*i* being spaced apart from an outer surface of the LED 150. The inner surface 111*i* can receive the incident light from the LED 150 and create a reflected beam that exits the lens 111 through the outer surface 1110 that causes the beam to diverge. The outer surface 111*o* can be convex lens surface, for example. In some embodiments, the inner surface 111*i* has a concave shape different from the a convex shape of the outer surface 111*o*. In one embodiments, the concave shape of the inner surface 111*i* is offset from the outer surface 111*o*.

Figure 8C:
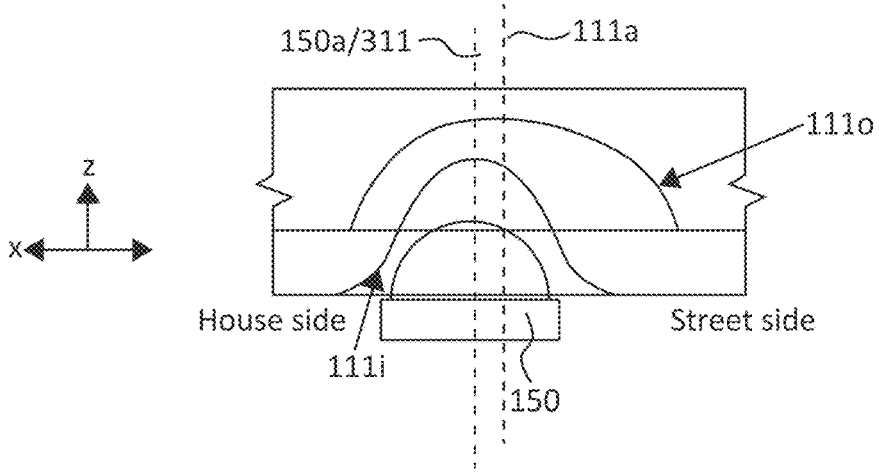
FIG. 8C is a cross-section view of the lens and the light source viewed from a front with a house side on the left and a street side on the right illustrating asymmetry of the lens with respect to the light source, according to one embodiment.

As noted above, each lens 111-115 can comprise a cavity 140 (see FIG. 4C and 7A) that has a concave shape or an egg-shaped outline. The egg-shaped outline may be oval shaped with one end or side being thicker than the other. The cavity 140 can be filled with air between the inner surface 111*i* and the LED 150. The cavity 140 receives light from the LED 150. In some embodiments, the lens 111 comprises a receptacle in which the LED 150 can be seated or is otherwise disposed. The receptacle can be irregularly shaped to receive a circuit board to which one or more light emitting diodes is mounted, for example. 100491 Referring to FIGS. 8A-8B, a lens (e.g., lens 111) is symmetric in a reference plane 311 located at the optical axis of the lens and when viewed from the house side toward the street side. Additionally, referring to FIGS. 8A and 8C, the lens is asymmetric about the reference plane 311 located when viewed from a front (e.g., with house side on the left and street side on the right in FIG. 8A and 8C). As shown in FIG. 8C, the reference plane 311 separates the lens into a street-side half and a house-side half. The street-side half is larger in size than the house-side half in order to reduce the size of the optical system while providing better cut-off. The street-side half controls a main beam emitted from the LED 150 and bulge toward a desired direction (e.g., between)55°-75° directs more light intensity toward the bulge. The house-side half acts as the light transmission layer which sends the light to the reflector 201. Such lens construction advantageously sends more light towards a desired direction through the lens For example, a reduced size of a lens portion (e.g., a house-side lens portion) provides better light beam cutoff by the reflector as well as enables lowering a height of the reflector 201 thereby making an optical assembly compact. For example, by offsetting the cavity 140 and LED 150 in a direction of the reflector 201, the central axis 150*a* of the LED 150 may be positioned closer to the reflector 201, which may enable a height of the reflector 201 to be reduced while still providing a desired cutoff angle for light.

Referring to FIGS. 3, 6, 7, 8A, 9A and 9B, each reflector 201 may protrude from the base 100 and may have a curved surface 201*c*. For example, each reflector 201 may include a first side that includes curved surface 201*c* (e.g., street side) and an opposite second side 201*b* (e.g., a house-side or a side behind the curved surface 201*c*). In one embodiment, the reflector 201 is an elongated member having a reflective material or coating on the curved surface 201*c*, while the second side may be painted black (or other dark color) to prevent light from a different row of LEDs from reflecting toward the house side. Each reflector 201 is disposed adjacent to the plurality of lenses 111-115 having corresponding plurality of LEDs 150 therein such that the plurality of LEDs 150 or lenses 111-115 are at the first side (e.g., street side). As illustrated, the curved surface 201*c* extends in a direction perpendicular to the plane of the base 100, however in other embodiments the curved surface 201*c* may extend from the base 100 at other angles. The curved surface 201*c* curves over the plurality of LEDs 150 located in the corresponding plurality of lenses 111-115. The curved surface 201*c* further extends beyond the central axis 150*a* of the LED 150. Accordingly, the curved surface 201*c* is configured to direct light emitted by the plurality of LEDs 150 toward the first side (e.g., the street side) and prevent the light from leaking toward the second side (e.g., the house side) of the reflector 201.

Referring to FIG. 3, the optical assembly 10 can include a plurality of reflectors 201, 202, 203 and 204 and corresponding rows of lenses and LEDs. In one embodiment, each reflector 201-204 has same construction and positioned in a similar manner with respect to the corresponding plurality of LEDs. For example, the reflector 202 is positioned adjacent to the second plurality of lenses 121-125 covering a corresponding plurality of LEDs 150 such that the curved surface 202*c* extends over and beyond a central axis of the LED 150. While shown with a single reflector extending along a length of each row of LEDs 150, it will be appreciated that in some embodiments multiple reflectors may be provided for each row of LEDs 150. For example, each LED 150 and lens pair (or a number of pairs within each row) may include a dedicated reflector.

In FIG. 3, the plurality of lenses, the plurality of LEDs, and reflectors are disposed in a number of rows. For example, as shown in FIG. 3, the first plurality of lenses 111-115 are arranged in a first row and a first plurality of LEDs (e.g., see 111 in FIG. 4C) disposed in corresponding lens of the first plurality of lenses 111-115. The first reflector 201 is disposed adjacent to the first plurality of lenses 111-115 on an opposite side of the second plurality of lenses 121-125 such that the curved surface 201*c* of the first reflector 201 extends over the first plurality of lenses 111-115.

The second plurality of lenses 121-125 are arranged in a second row spaced from the first row and a second plurality of LEDs (e.g., see LED 150 in lens 121 in FIG. 4C) disposed in the corresponding second plurality of lenses 121-125. The second reflector 202 is disposed between the first plurality of lenses 111-115 and the second plurality of lenses 121-125 such that a curved surface 202*c* of the second reflector 202 extends over the second plurality of lenses 121-125. In other words, with respect to the reflector 202, the second plurality of LEDs in the lenses 121-125 are located at the first side (e.g., street side), and the first plurality of lenses 111-115 are located at the second side (e.g., house side). In some embodiments, the second side of the reflectors 201-204 can be coated or formed from a black (or other dark color) material to absorb light emitted by LEDs on the second side or partially reflective to reflect light emitted by LEDs on the second side without interfering with the light emitted by LEDs on the first side.

In some embodiments, as shown in FIG. 3, the reflector 201 (and 202-204) can include side reflectors between each lens to redirect and reflect the light traveling in a direction that is aligned with or substantially aligned with a length of reflector 201 in a desired direction (e.g., street side) thereby improving the illumination profile at the street side. The side reflectors may also prevent light interference between adjacent LEDs thereby improving efficiency of light utilization. For example, the reflector 201 includes side reflectors 211, 212, 213 and 214 projecting from the curved surface 201*c* toward the first side (e.g., street side). In some embodiments, the side reflectors 211-214 may be curved or transition from the surface of the reflector 201. In some embodiments, the side reflectors 211-214 may be angled (e.g., up to)5° with respect to a perpendicular to the base 100. The side reflector 211 has a reflecting surface 211*r* facing the LED in the lens 111. The side reflector 212 located between the lens 111 and 112 has two reflecting surfaces 212*r*, one surface 212*r* faces the lens 111 and another surface 212*r* faces the lens 112. Similarly, each of the side reflectors 213 and 214 has reflecting surfaces 213*r* and 214*r* facing the lens 113 and 114.

Accordingly, the optical assembly 10 can be configured to direct light from each row of LEDs via a corresponding reflector toward the street without light interference between LEDs or light interference between adjacent rows of LEDs. Thus, light emitted from each LED or rows of LEDs can be better directed to a desired direction (e.g., street side) to improve light utilization, while cutting off or otherwise preventing light emitted by the optical assembly 10 from being directed toward undesired directions (e.g., house side).

In some embodiments, as shown in FIGS. 7A, 8A and 9A-9B, the curved surface 201*c* of the reflector 201 can have a partially concave shape. However, the present disclosure is not limited to a concave shape. In some embodiments, different curved surfaces can be created to direct light in a desired direction. For example, the curved surface 201*c* of the reflector 201 can have a parabolic shape extending from the base 100 toward and beyond the central axis of the plurality of LEDs. As another example, the curved surface 201*c* of the reflector 201 can have a free form shape characterized by multiple curvatures between end points of the curved surface 201*c*, with a first end point being at the junction of the curved surface 201*c* and the base 100 and a second end point being a distal end of the curved surface 201*c* that extends over the plurality of lenses 111-115. For example, the free form shape comprises a first curvature between the first end point at the base 100 and an intermediate point between the first end point and the second end point; and a second curvature between the intermediate point and the second end point of the curved surface. The free form may be generally characterized by the curved portion elongating in a direction of the selected area (e.g., a street-side direction).

In some embodiments, the reflector 201 has a curved surface 201*c* with a linear segment extending approximately perpendicularly from the base 100 up to a height corresponding to a top of the outer surface 111*o* of the lens 111. Extending from the linear segment, the curved surface 201*c* can extend further with a curve toward the central axis of the LED. For example, the curve can be characterized by a by a plurality of points connected by curved line segments. The series of curved segments each comprise reflector and a curvature having a profile of an arc segment of an ellipse, a parabolic curvature, a hyperbolic curve, or other second or higher degree curve portions.

Figure 9A:
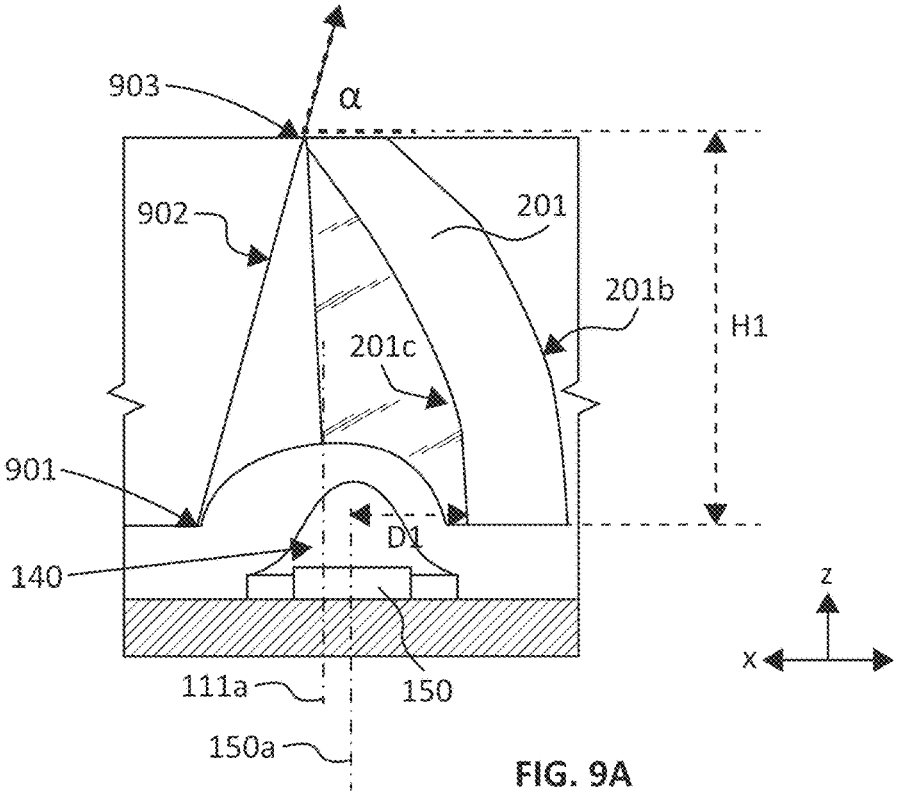
FIG. 9A illustrates a first angle associated with the reflector characterizing a curved surface, according to one embodiment.
Figure 9B:
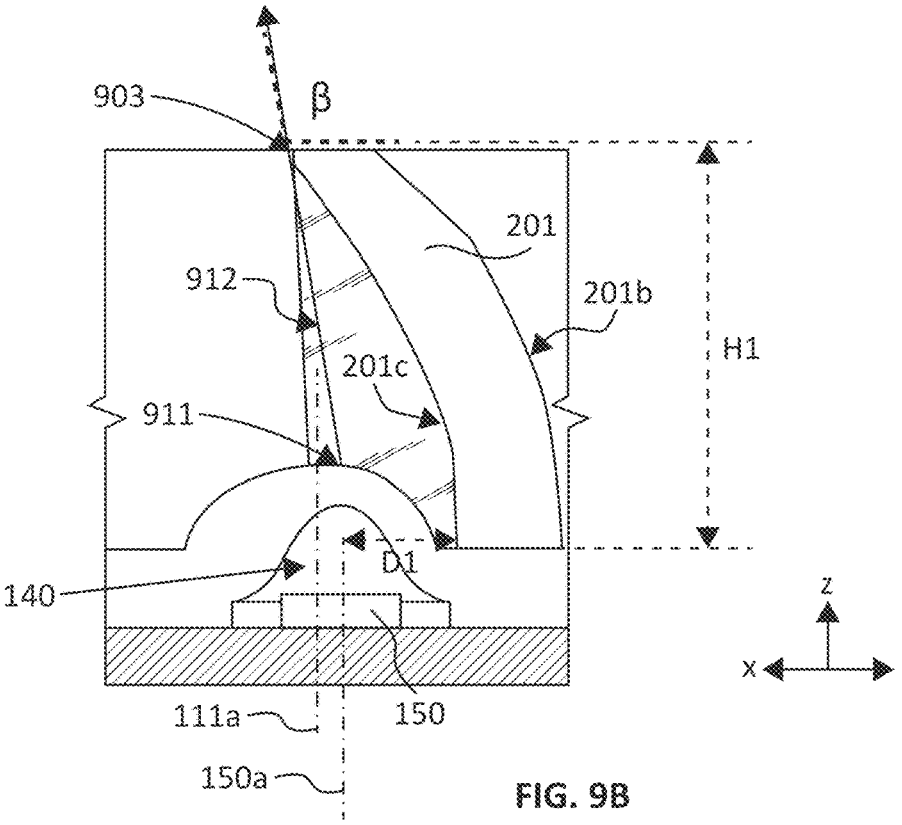
FIG. 9B illustrates a second angle associated with the reflector characterizing a curved surface, according to one embodiment.

Referring to FIGS. 9A and 9B, the curved surface 201*c* of the reflector 201 can be characterized by a first angle α, a second angle β, or both. The first angle α is formed between the base 100 and a line 902 that extends between a distal end 901 (e.g., street side) of the lens 111 furthest from the curved surface 201*c* and a distal end 903 of the curved surface 201*c* located over the lens 111. The second angle β is formed between the base 100 and a line 912 that extends from a position 911 of the top surface of the lens 111 that is aligned with the central axis 150*a* of the LED 150 and the distal end 903 of the curved surface 201*c* located over the lens 111.

In some embodiments, the first angle α can be in a range between 60° and 90° (e.g., between 60°-70°, 70°-80°, 80°-90° or other narrow ranges). In some embodiments, greater angles may further enable the height of the reflector to be decreased and/or may provide sharper backlight cutoff.

In some embodiments, the second angle β can be in a range between 70° and 130°. In some embodiments, the reflector 201 that satisfies the first angle α, the second angle β, or both facilitates a compact design, while providing a desired cutoff of the backlight (e.g., light directed toward the house side). For example, the curved surface 201*c* of the reflector that satisfies the first angle and the second angle conditions facilitates reducing a height of the reflector 201 required to cuttoff the backlight and also allows positioning of the LEDs 150 proximate to the curved surface 201*c* so that the light from the LEDs can be directed in a desired direction (e.g., street side). In other words, the first angle α and the second angle β bring the distal end 903 of the curved surface 201*c* closer to the LEDs while facilitating cutoff of the backlight (e.g., light directed toward the house side).

Figure 9C:
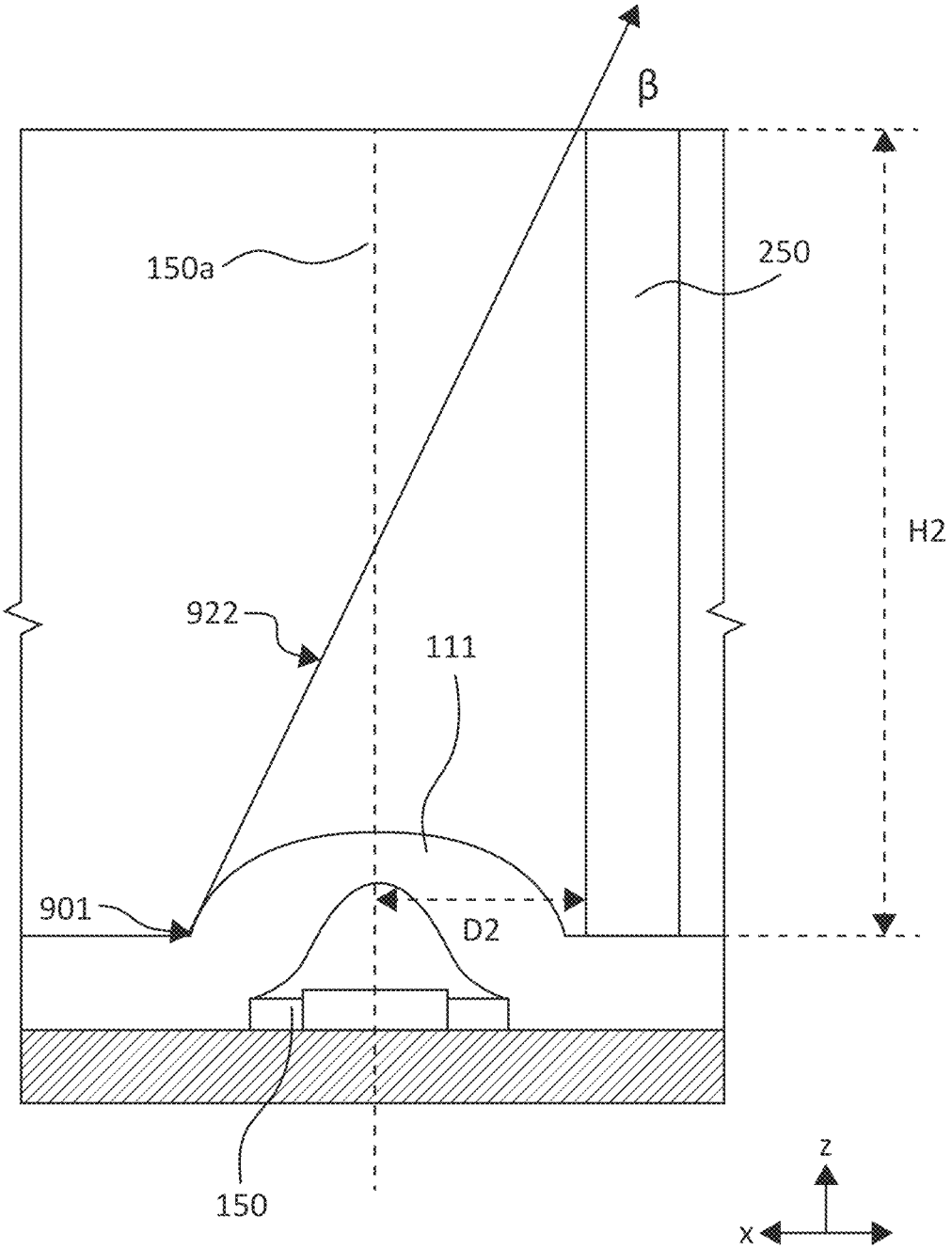
FIG. 9C (Prior art)
FIG. 9C illustrates a traditional reflector with straight surface, according to one embodiment.

In some embodiments, referring to FIGS. 9A-9C, the curved surface 201*c* of the reflector 201 facilitates compact design compared to a straight edge reflector 250 (see FIG. 9C). For example, the curved surface 201*c* extends over the central axis 150*a* of the LED 150 which allows the beam emitting from the LED and transmitted by the lens 111 to be cutoff close to the lens 111 before the beam can spread. The height of the curved surface 201*c* can be H1. On the other hand, if the straight edge reflector 250 is used, a height H2 of the straight edge reflector 250 from the base 100 to intercept a beam 922 transmitted at the end 901 of the lens 111. Comparing FIGS. 9A and 9C shows that the beam 902 is intercepted at the curved surface 201*c* within a short distance. For example, the H1/H2 ratio may be between ⅓ to ½. On the other hand, the beam 922 needs to travels much further before being intercepted by the straight edge reflector 250. Thus, the height H1 of the reflector 201 can be substantially smaller than the height H2 of the straight edge reflector 250 while still providing the desired backlight cutoff ability. As such, using reflector 201 a more compact illumination system (e.g., a luminaire) can be designed.

Figure 10:
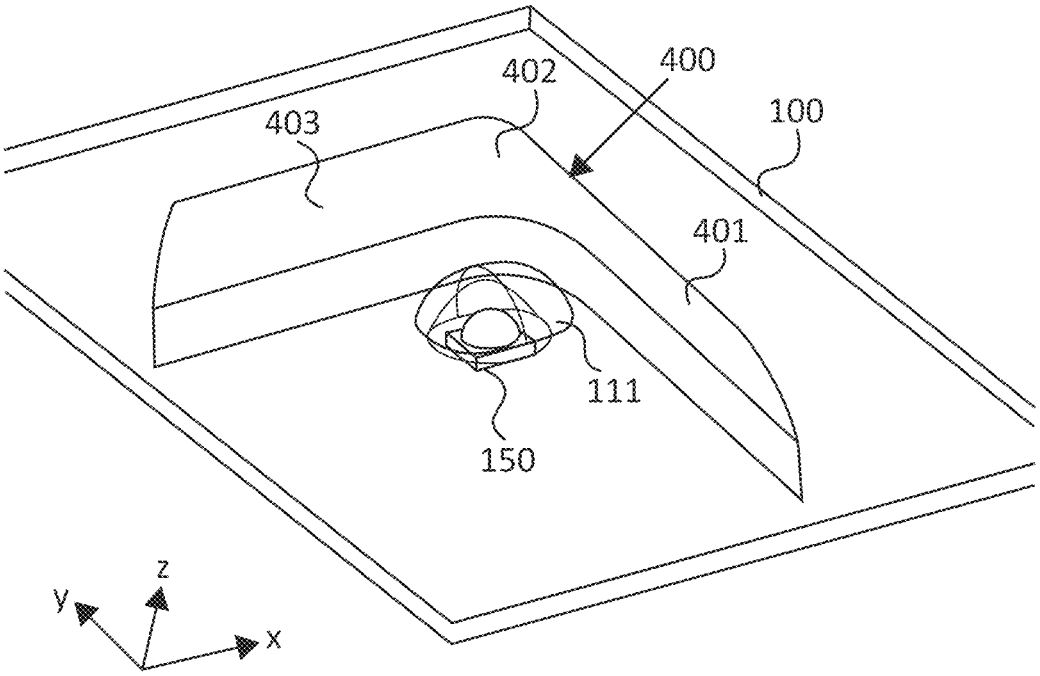
FIG. 10 is a perspective view of a corner reflector assembled on a base with a light source disposed in the lens, according to one embodiment.
Figure 11:
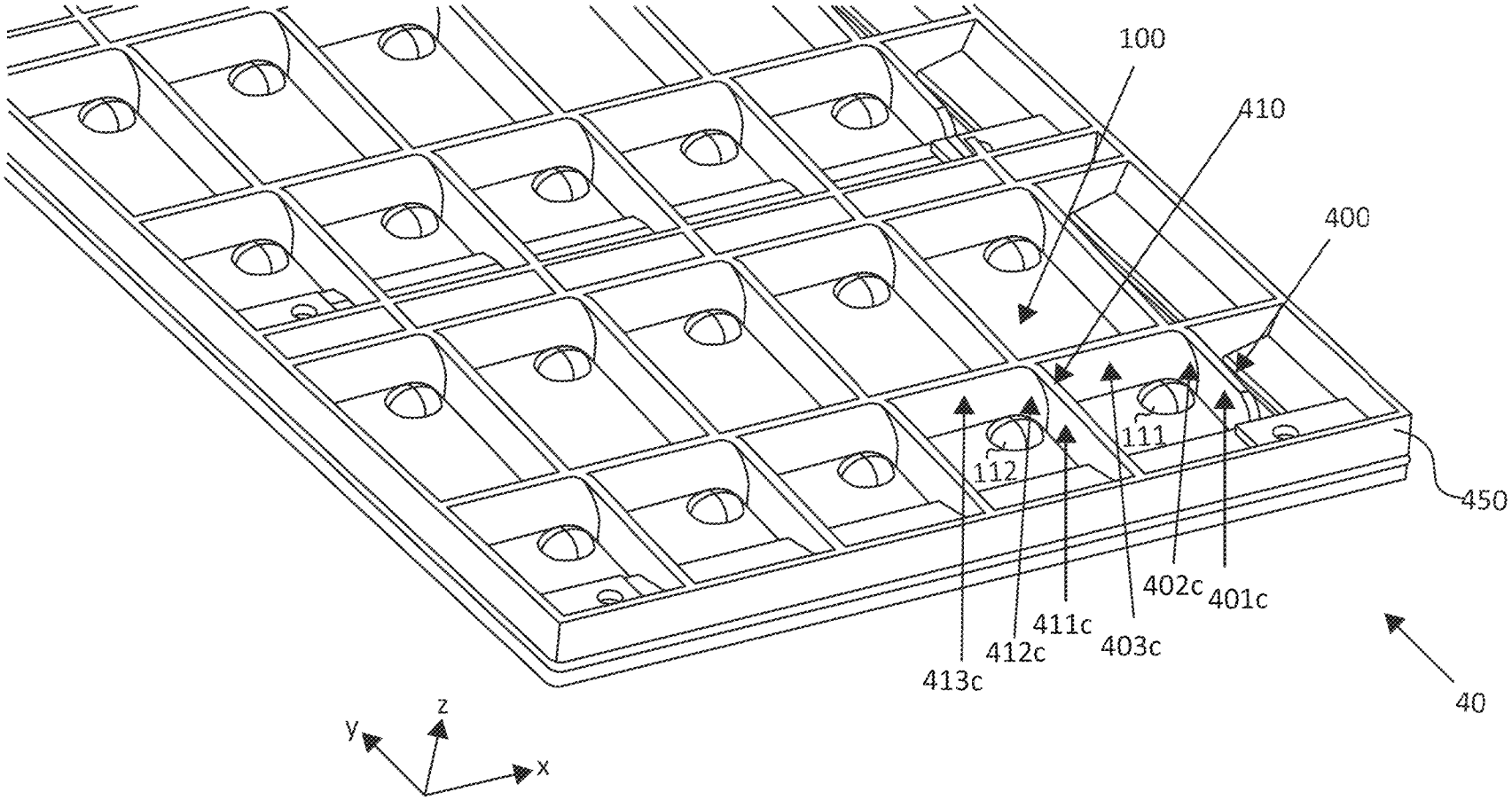
FIG. 11 is a perspective view of an optical assembly with a plurality of corner reflectors assembled on a base with a plurality of light sources disposed in corresponding lenses, according to one embodiment.

In some embodiments, a reflector can have an angular shape to light a corner space. In some embodiments, as shown in FIGS. 10 and 11, a reflector 400 can be angular in shape comprising a first curved surface portion 401, a second curved surface portion 403 disposed at an angle with the first curved surface portion 401, and a corner surface portion 402 connecting the first curved shape portion 401 and the second curved shape portion 401. The first curved surface portion 401 and the second curved surface portion 403 have curved surfaces 401*c* and 403*c*, respectively. The curved surfaces 401*c* and 403*c* can have similar structure as the curved surface 201*c* of the reflector 201 discussed herein. The corner surface portion 402 also has a curved surface 402*c* to direct the light emitted towards a corner back to a desired direction (e.g., street side). In one embodiment, the curved surface portion 402 curves along multiple axes to connect the first curved shape portion 401 and the second curved shaped portion 403. Likewise, the curved surface 402*c* of the curved surface portion 402 also curves along multiple axes (e.g., x and y axis in the plane defined by the base 100) connecting the curved surfaces 401*c* and 403*c* and also further curves along another axis (e.g., z axis perpendicular to the base 100) and extends over the lens to at least partially cover the lens.

FIG. 11 illustrates an exemplary corner optical assembly 40 comprising a plurality of corner reflectors such as reflectors 400 and 410. At the corners of each reflector 400 and 410, an LED 150 is placed in each of the lenses 111 and 112, respectively. The curved surfaces 401*c*, 402*c* and 403*c* of the reflector 400 face the LED 150 in the lens 111. Similarly, the curved surfaces 411*c*, 412*c* and 413*c* of the reflector 410 face the LED 150 in the lens 112. The optical assembly 40 includes additional similar corner reflectors, and lenses, although not numbered. As discussed herein, the reflectors 400 and 410, and lenses 111 and 112 of the optical assembly 40 can be installed on the base 100. The base 100 along with the reflectors, lens, and LEDs can be further supported by a frame 450. The frame 450 can provide a support structure for the base and reflectors. The frame 450 can be further adapted to be installed in a casing of a luminaire.

Figure 12:
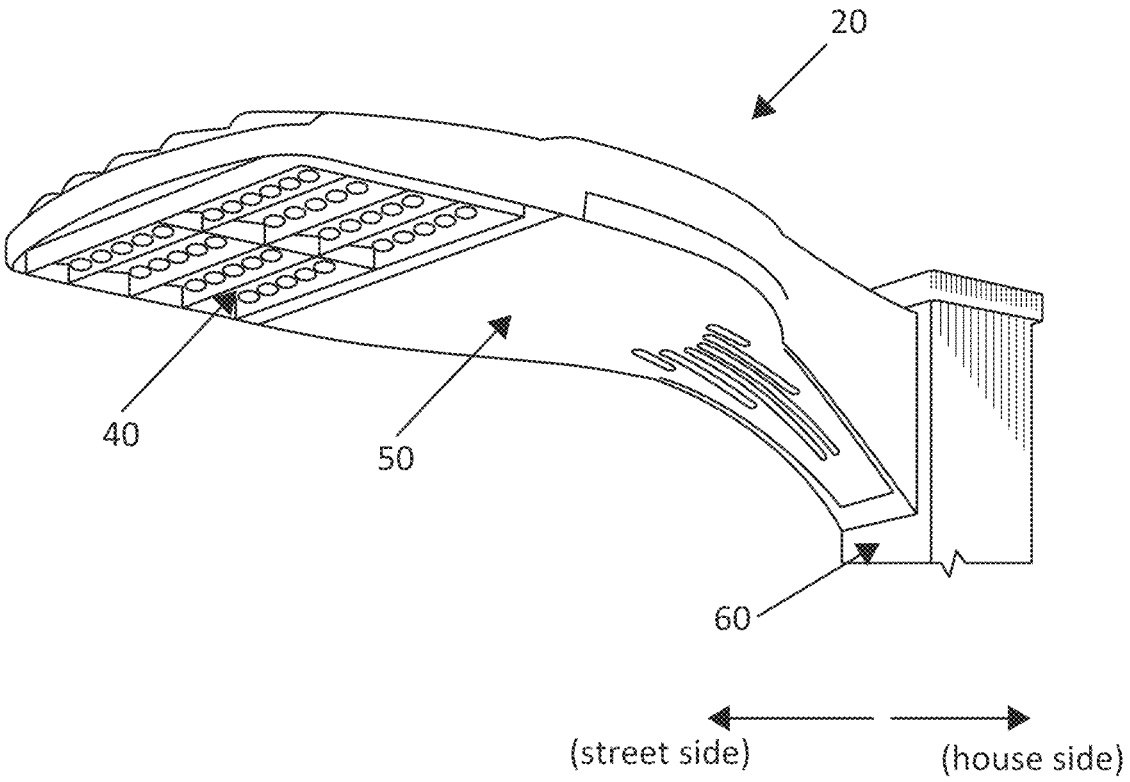
FIG. 12 is a luminaire employing the optical assembly having the corner reflectors assembled of FIG. 11, according to one embodiment.

FIG. 12 illustrates an example luminaire 20 implementing a corner optical assembly 40 having angular reflectors 250. The corner optical assembly 40 can be installed in a casing 50 coupled to a pole 60. The pole 60 can be installed at the housing side and the casing 50 can extend toward the street or a corner desired to be illuminated. While not illustrated, optical assembly 10 may be incorporated into a luminaire, similar to luminaire 20.

The optical assembly discussed herein can be configured for various applications. For example, the optical assembly can be used to illuminate a selected area (e.g., a street) while cutting off and/or otherwise preventing leakage of the light away from the selected area (e.g., towards a house). For this purpose, the reflector can be curved as discussed herein. The optical assembly can be oriented with optical axis of the downward towards ground (e.g., see FIGS. 2 and 7B), and the curved surface of the reflector directs the light toward a selected area (e.g., the street, a pathway, or other indoor or outdoor areas). The reflector can be configured as a corner reflector (e.g., see FIGS. 10-12) to direct light to a particular corner. In some embodiments, the optical assembly can be a combination of curved reflector like 201 and corner reflector like 400. In some embodiments, the optical axis of the LEDs can be oriented upward and reflectors can be positioned to direct light to a particular wall, porch, or an object of interest for decorative purposes. It can be understood that the present application uses a selected area as a street to illustrates the concepts. However, the present disclosure is not limited to a particular application and the optical assembly may be configured to direct light to any selected area or region that is indoor (e.g., a wall inside a house) or outdoor (e.g., a street, a walkway, a porch, etc.).

Different arrangements of the components depicted in the drawings or described above, as well as components and steps not shown or described are possible. Similarly, some features and subcombinations are useful and may be employed without reference to other features and subcombinations.

While certain embodiments have been described, these embodiments have been presented by way of example only, and are not intended to limit the scope of the present disclosures. Indeed, the novel methods, apparatuses and systems described herein can be embodied in a variety of other forms; furthermore, various omissions, substitutions and changes in the form of the methods, apparatuses and systems described herein can be made without departing from the spirit of the present disclosures. The accompanying claims and their equivalents are intended to cover such forms or modifications as would fall within the scope and spirit of the present disclosures.

What is claimed is:

1. An optical assembly comprising:

a base having an upper surface;

a plurality of lenses exposed on the upper surface of the base, each lens having a dome shape having a central axis perpendicular to a plane of the base;

a plurality of light emitting diodes (LED), each LED positioned to emit light into a respective lens of the plurality of lenses, each LED having a central axis perpendicular to a plane of the LED, the central axis of an LED being offset from the central axis of the respective lens of the plurality of lenses; and at least one reflector having a curved surface, the at least one reflector being disposed adjacent to at least one of the plurality of LEDs such that the at least one of the plurality of LEDs is at a first side of the at least one reflector, the curved surface extending from the base and curving over the at least one of the plurality of LEDs and beyond the central axis of the at least one of the plurality of LEDs, the curved surface being configured to direct light emitted by the at least one of the plurality of LEDs toward the first side and prevent the emitted light from leaking toward a second side of the at least one reflector that is opposite the first side, wherein each lens of the plurality of lenses defines a cavity, and each LED of the plurality of LEDs is disposed in the cavity of the respective lens such that the central axis of the LED is offset relative to the central axis of the respective lens in a direction toward the curved surface of the at least one reflector.

2. The optical assembly of claim 1, wherein the curved surface of the reflector has a concave shape.

3. The optical assembly of claim 1, wherein the curved surface of the reflector has a parabolic shape extending from the base toward and beyond the central axis of the plurality of LEDs.

4. The optical assembly of claim 1, wherein the curved surface of the reflector has a free form shape characterized by multiple curvatures between end points of the curved surface, a first end point being at the base and a second end point being positioned above at least some of the plurality of lenses.

5. The optical assembly of claim 4, wherein the free form shape comprises:

a first curvature between the first end point at the base and an intermediate point between the first end point and the second end point; and a second curvature between the intermediate point and the second end point of the curved surface.

6. The optical assembly of claim 1, wherein the reflector is an elongated member having a reflective coating on the curved surface.

7. The optical assembly of claim 1, wherein the curved surface of the reflector is characterized by at least one of:

a first angle between a first line and a plane of the base, the first line joining a distal end of a lens furthest laterally from the reflector at the base and a distal end of the reflector located over the lens, and a second angle between a second line and the plane of the base, the second line joining a point on the lens located at the central axis of the LED and the distal end of the reflector located over the lens.

8. The optical assembly of claim 7, wherein the first angle is in a range between 60° and 90°.

9. The optical assembly of claim 7, wherein the second angle is in a range between 70° and 130°.

10. The optical assembly of claim 1, wherein the base comprises a light absorbing material or coating.

11. The optical assembly of claim 10, wherein the light absorbing material or coating is black.

12. The optical assembly of claim 1, wherein the plurality of lenses is attached to the base by an adhesive.

13. The optical assembly of claim 1, wherein:

the plurality of lenses comprises: a first plurality of lenses arranged in a first row; and a second plurality of lenses arranged in a second row; and the plurality of LEDs comprises: a first plurality of LEDs disposed in the first plurality of lenses; and a second plurality of LEDs disposed in the second plurality of lenses.

14. The optical assembly of claim 13, wherein the at least one reflector comprises:

a first reflector disposed proximate to the first plurality of lenses such that a curved surface of the first reflector extends over the first plurality of lenses; and a second reflector disposed between the first plurality of lenses and the second plurality of lenses such that a curved surface of the second reflector extends over the second plurality of lenses.

15. The optical assembly of claim 1, wherein the at least one reflector extends along a single lens of the plurality of lenses.

16. The optical assembly of claim 1, wherein the at least one reflector has an angular shape comprising a first curved surface portion, a second curved surface portion disposed at an angle with the first curved surface portion, and a corner portion between the first curved surface portion and the second curved surface portion, the corner portion having a curved surface extending along multiple axes.

17. The optical assembly of claim 16, wherein the curved surface of the corner portion of the at least one reflector curves between the first curved surface portion and the second curved surface portion, and also curves in a plane perpendicular to the base.

18. An optical assembly, comprising:

a base having an upper surface;

a plurality of lenses exposed on the upper surface of the base, each lens having a dome shape having a central axis perpendicular to a plane of the base;

a plurality of light emitting diodes (LED), each LED positioned to emit light into a respective lens of the plurality of lenses, each LED having a central axis perpendicular to a plane of the LED, the central axis of an LED being offset from the central axis of the respective lens of the plurality of lenses; and at least one reflector being disposed adjacent to at least one of the plurality of LEDs such that the at least one of the plurality of LEDs is at a first side of the at least one reflector, the at least one reflector having an angular shape comprising a first curved surface portion, a second curved surface portion disposed at an angle with the first curved surface portion, and a corner portion between the first curved surface portion and the second curved surface portion, the corner portion having a curved surface extending along multiple axes, wherein the curved surface of the corner portion curves between the first curved surface portion and the second curved surface portion and curves in a plane perpendicular to the base, the curved surface extending from the base and curving over the at least one of the plurality of LEDs and beyond the central axis of the at least one of the plurality of LEDs, the curved surface being configured to direct light emitted by the at least one of the plurality of LEDs toward the first side and prevent the emitted light from leaking toward a second side of the at least one reflector that is opposite the first side, wherein a lens of the plurality of lenses is located proximate the corner portion such that the curved surface of the corner portion curves at least partially over the lens.

19. A luminaire configured to illuminate a selected area, the luminaire comprising:

an optical assembly comprising:

a base having an upper surface;

a plurality of lenses exposed on the upper surface of the base, each lens having a dome shape having a central axis perpendicular to a plane of the base;

a plurality of light emitting diodes (LED), each LED positioned to emit light into a respective lens of the plurality of lenses, each LED having a central axis perpendicular to a plane of the LED, the central axis of an LED being offset from the central axis of a respective lens of the plurality of lenses; and at least one reflector having a curved surface, the at least one reflector being disposed proximate to at least one of the plurality of LEDs such that the at least one of the plurality of LEDs is at a first side of the at least one reflector, the curved surface extending from the upper surface of the base and curving over the at least one of the plurality of LEDs and beyond the central axis of the at least one of the plurality of LEDs, the curved surface being configured to direct light emitted by the at least one of the plurality of LEDs toward the first side and prevent the light from leaking toward a second side of the at least one reflector that is opposite the first side, wherein each lens of the plurality of lenses defines a cavity, and each LED of the plurality of LEDs is disposed in the cavity of the respective lens such that the central axis of the LED is offset relative to the central axis of the respective lens in a direction toward the curved surface of the at least one reflector; and a frame supporting the optical assembly, the frame being oriented such that the curved surface of the at least one reflector curves toward the selected area to direct the light emitted from the at least one of the plurality of LEDs toward the selected area and prevent light from leaking in a direction that is away from the selected area.

20. The luminaire of claim 19, wherein the curved surface of the reflector has at least one of:

a concave shape;

a parabolic shape extending from the base toward and beyond the central axis of the at least one of the plurality of LEDs; or a free form shape characterized by multiple curvatures between end points of the curved surface, a first end point being at the base and a second end point being positioned above at least one of the plurality of lenses.

* * * * *